US007867144B2

(12) United States Patent
Quinn

(10) Patent No.: US 7,867,144 B2
(45) Date of Patent: Jan. 11, 2011

(54) APPARATUS FOR EXERCISING THE CHEST AND BACK

(76) Inventor: Anthony Quinn, Hicks Tower, Coast Road, Malahide, County Dublin (IE)

( * ) Notice: Subject to any disclaimer, the term of this patent is extended or adjusted under 35 U.S.C. 154(b) by 0 days.

(21) Appl. No.: 12/083,827

(22) PCT Filed: Oct. 23, 2006

(86) PCT No.: PCT/IE2006/000117

§ 371 (c)(1),
(2), (4) Date: Oct. 31, 2008

(87) PCT Pub. No.: WO2007/046079

PCT Pub. Date: Apr. 26, 2007

(65) Prior Publication Data

US 2009/0258761 A1 Oct. 15, 2009

(30) Foreign Application Priority Data

Oct. 21, 2005 (IE) ..... 2005/0705
Oct. 21, 2005 (IE) ..... 2005/0706
Oct. 21, 2005 (IE) ..... 2005/0708

(51) Int. Cl.
*A63B 3/00* (2006.01)

(52) U.S. Cl. ..... 482/41; 482/93; 482/101; 482/142

(58) Field of Classification Search ..... 482/38, 482/41, 95, 101, 133; 182/93, 106, 115, 182/116

See application file for complete search history.

(56) References Cited

U.S. PATENT DOCUMENTS

| | | | | |
|---|---|---|---|---|
| 3,658,327 | A * | 4/1972 | Thiede | 482/96 |
| 3,892,404 | A * | 7/1975 | Martucci | 482/96 |
| 4,111,414 | A | 9/1978 | Roberts | |
| 4,846,458 | A | 7/1989 | Potts | |
| 5,011,139 | A | 4/1991 | Towley, III | |
| 5,322,489 | A * | 6/1994 | Webb et al. | 482/38 |
| 5,372,556 | A | 12/1994 | Ropp | |
| 5,554,083 | A * | 9/1996 | Chen | 482/95 |
| 5,967,955 | A * | 10/1999 | Westfall et al. | 482/142 |
| 7,361,125 | B2 * | 4/2008 | Webber et al. | 482/95 |
| 2004/0166998 | A1 * | 8/2004 | Campanaro et al. | 482/95 |
| 2006/0035764 | A1 * | 2/2006 | Webber | 482/94 |
| 2006/0247097 | A1 * | 11/2006 | La Voie et al. | 482/8 |

FOREIGN PATENT DOCUMENTS

DE 201 07 210 12/2001

OTHER PUBLICATIONS

International Search Report dated May 4, 2007.

* cited by examiner

*Primary Examiner*—Tatyana Zalukaeva
*Assistant Examiner*—Shila Abyaneh
(74) *Attorney, Agent, or Firm*—Jacobson Holman PLLC

(57) ABSTRACT

Apparatus for exercising muscles of the chest and back includes a frame, parallel bars and overhead bars attached to the frame. A seat supports a user during exercise and a weight stack can be adjusted to suit the user. The seat is vertically movable relative to the frame as exercises are being performed by the user.

17 Claims, 10 Drawing Sheets

APPARATUS FOR EXERCISING THE CHEST AND BACK

This is a national stage of PCT/IE2006/000117 filed Oct. 23, 2006 and published in English.

This invention relates to the field of resistance training apparatus, in particular apparatus for medium to heavy resistance training of the chest and back muscles.

BACKGROUND OF THE INVENTION

Exercisers who wish to develop the chest and neck muscles in particular may wish to do dips, which exercise the chest and back muscles and overhead pull-ups with the arms separated, which exercise especially the back muscles. Traditionally these are performed on fixed parallel bars and fixed overhead bars respectively. These are considered powerful and effective exercises but are very difficult for most people as they involve in their traditional forms, the resistance of the entire bodyweight for which the person may not be strong enough. A further problem with the traditional approach is that the person may sway, swing, contort or leap to cheat the full impact of the exercise.

Apparatus to date has attempted to provide a system for providing variable levels of support to exercisers who cannot pull up with or dip with their entire body weight. For example, U.S. Pat. No. 5,322,489 describes support provided through the exerciser kneeling or standing on a platform which provides upward lift according to the level of weight selected.

Such systems suffer from the defect that the exerciser may vary his position in such a way that the exercise is rendered suboptimal or ineffective in that they may sway or lean in different ways to avoid the target muscles of the exercise being used.

Furthermore as the body is fully extended above the knees, full isolation of the pectorals and latissimus is unlikely to be achieved as with heavier resistance the exerciser will increasingly use his abdominals and erector spinae as accessories.

A further problem with existing art is that where a high weight is used to counterbalance the exerciser's own weight, the foot or knee support may spring up inconveniently when the exerciser attempts to alight.

STATEMENTS OF INVENTION

According to the invention there is provided apparatus for exercising muscles of the chest and back comprising:

- a frame;
- bars for gripping by a user in performing exercises;
- a seat for supporting a user during exercise;
- resistance means for the seat; and
- the seat being movable relative to the frame as exercises are being performed by a user.

In one embodiment the apparatus comprises a ladder for mounting and demounting the seat.

In one case the bars comprise parallel bars for gripping by a user in performing dip exercises.

The bars may alternatively or additionally comprise a pair of overhead bars for gripping by a user in performing pull-up exercises.

The overhead bars may be height adjustable. Preferably a gap between the overhead bars is width adjustable.

The overhead bars may be fixed to the frame.

In another embodiment the parallel bars are height adjustable. A gap between the parallel bars may be width adjustable.

In one case the parallel bars are fixed to the frame.

In one embodiment the resistance provided by the resistance means is adjustable. The resistance means may comprise a weight stack.

The seat may be connected to the resistance means by a connection means. The connection means may comprise a connector which is trained over a pulley means.

In one embodiment the apparatus comprises guide means for guiding movement of the seat.

The guide means may comprise guide rods and guide tubes for the guide rods. There may be linear bearings between the guide rods and guide tubes.

In one case the apparatus is a stand-alone exercise machine.

In another case the apparatus comprises one station of a multi-station exercise machine.

The present invention provides an exercise apparatus comprising:

- vertically moving seat which allows the exerciser to perform pull-ups on overhead bars or dips on parallel bars, the bars may be of fixed or variable height, and of fixed or variable width;
- ladder placed forward from the exercise station allowing the exerciser to safely mount and dismount the seat.

The vertically moving seat forces the person to use their latissimus, pectoral or triceps muscles as appropriate while precluding them from using their abdominals or erector spinae, or bending or twisting to avoid the impact of the exercise.

The invention also provides an exercise apparatus for exercising abdominal muscles comprising:

- a frame;
- a seat to support a user;
- a padded bar for engaging the user,
- the padded bar being mounted to a lever for adjustment of the position of the padded bar relative to the user for engaging different parts of the user in performing a range of exercises.

The invention also provides an exercise apparatus comprising:

- a frame;
- a seat;
- a back for the seat;
- a padded bar attached to a lever;
- the lever being connected to a resistance means;
- the back of the seat being adjustable to adapt to a correct posture for carrying out an exercise.

In one case the seat is also adjustable. There may be a four bar linkage between the seat back and frame to maintain planar movement.

BRIEF DESCRIPTION OF THE DRAWINGS

The invention will be more clearly understood from the following description therefore given by way of example only in which:—

DETAILED DESCRIPTION

Figure 1:
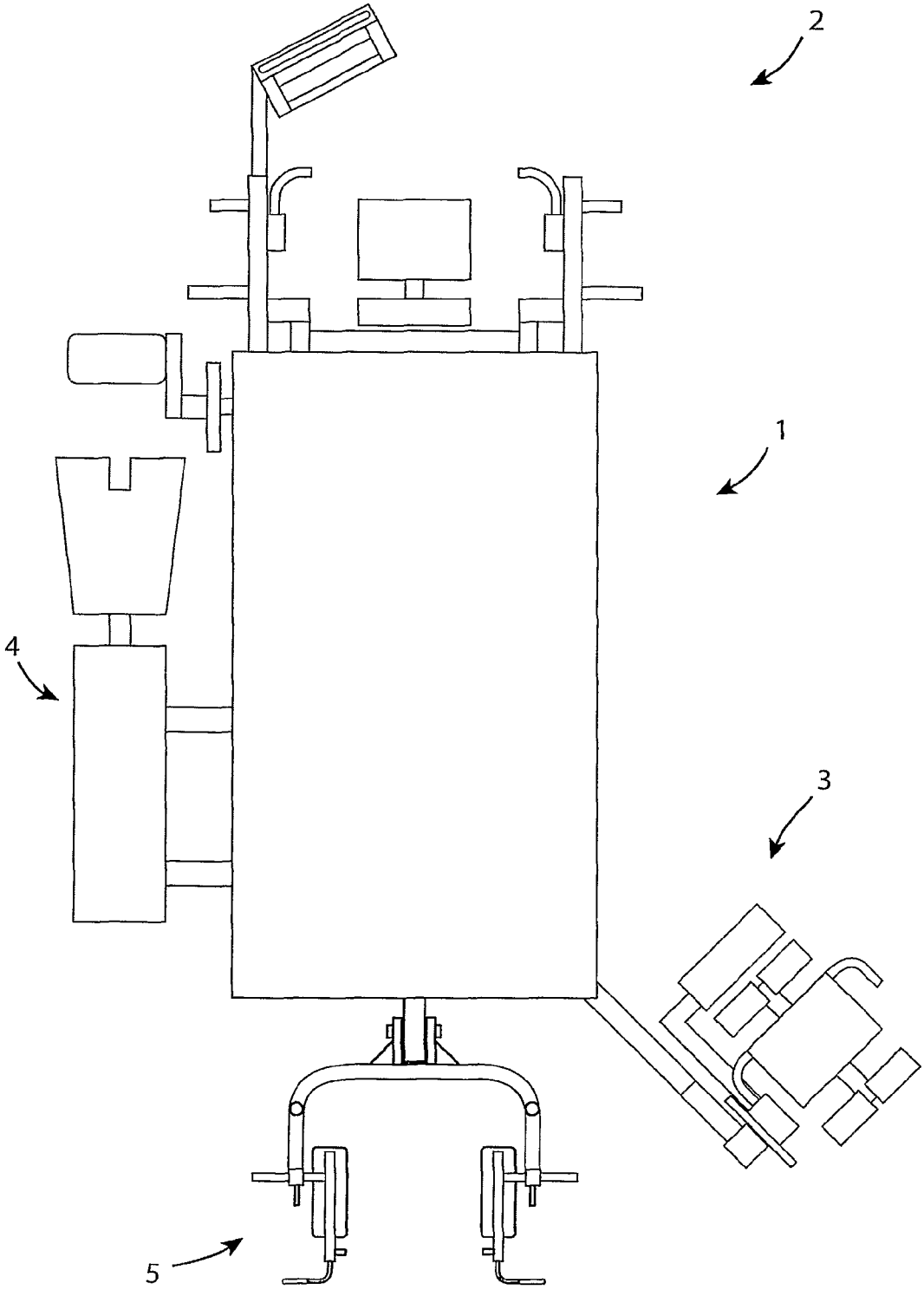
FIG. 1 is a plan view of a multi-station exercise apparatus according to the invention.
Figure 2:
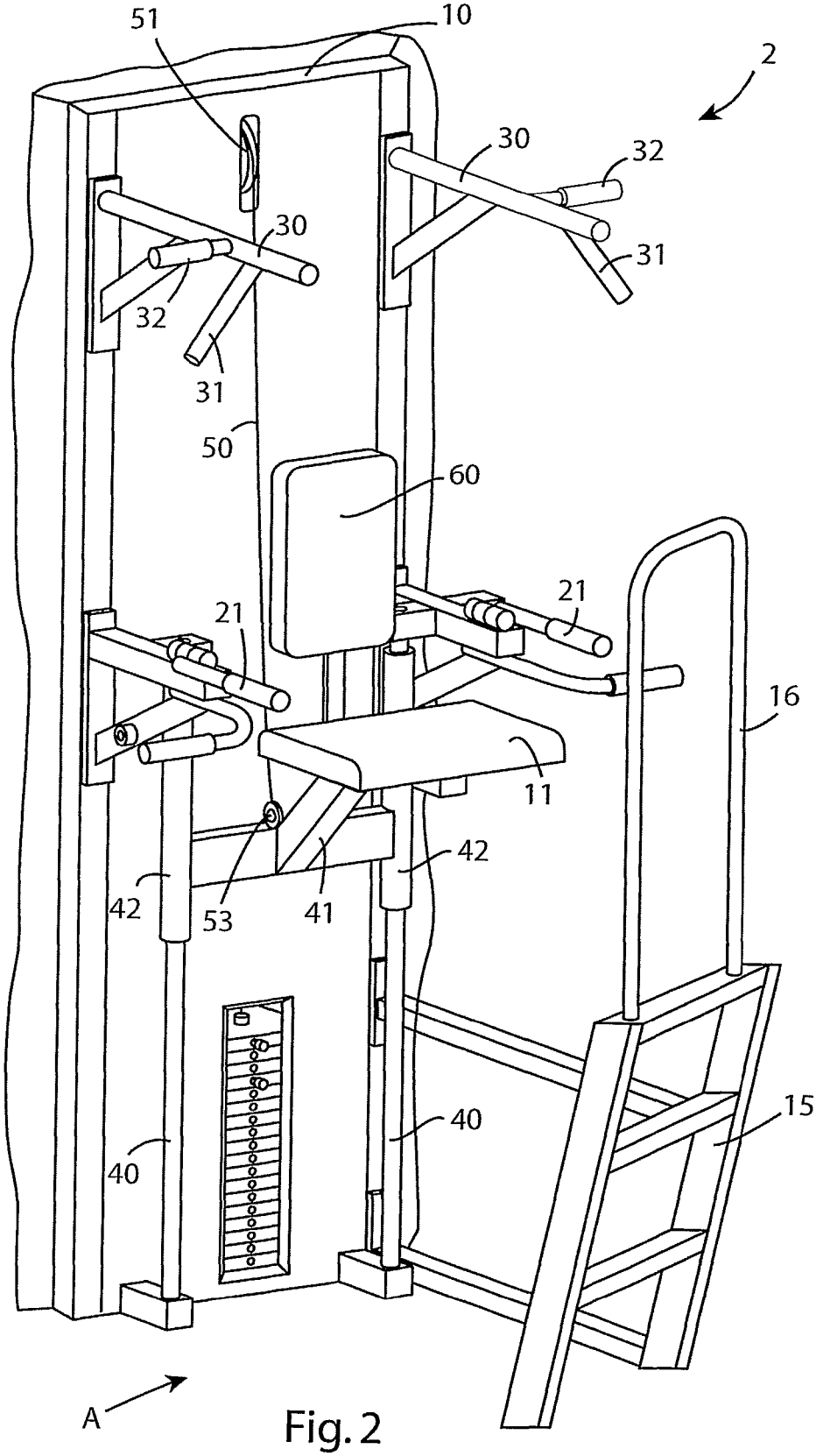
FIG. 2 is a perspective view of an apparatus for exercising the chest and back according to the invention.
Figure 3:
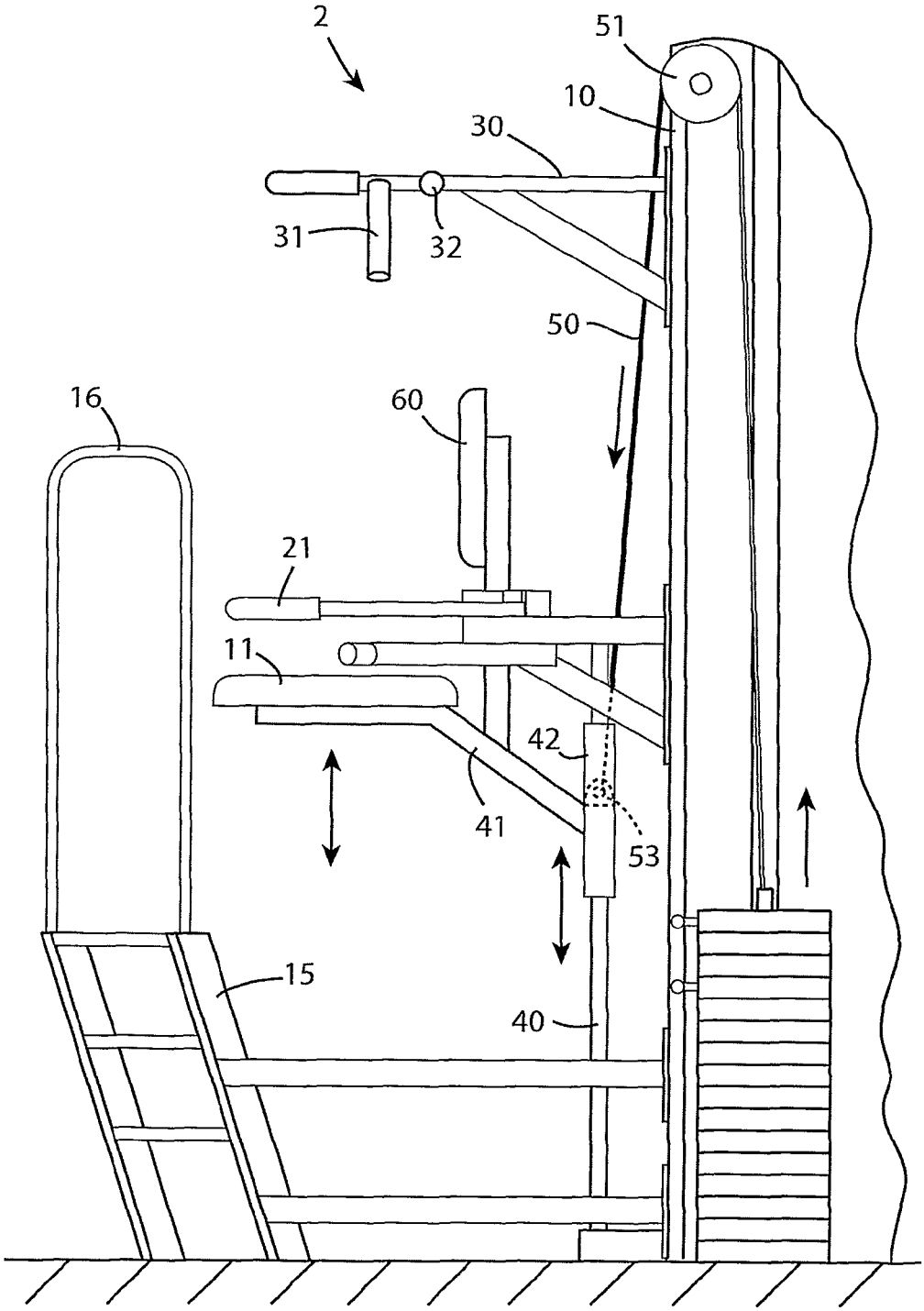
FIG. 3 is a side elevational view of the exercising apparatus of FIG. 2.
Figure 4:
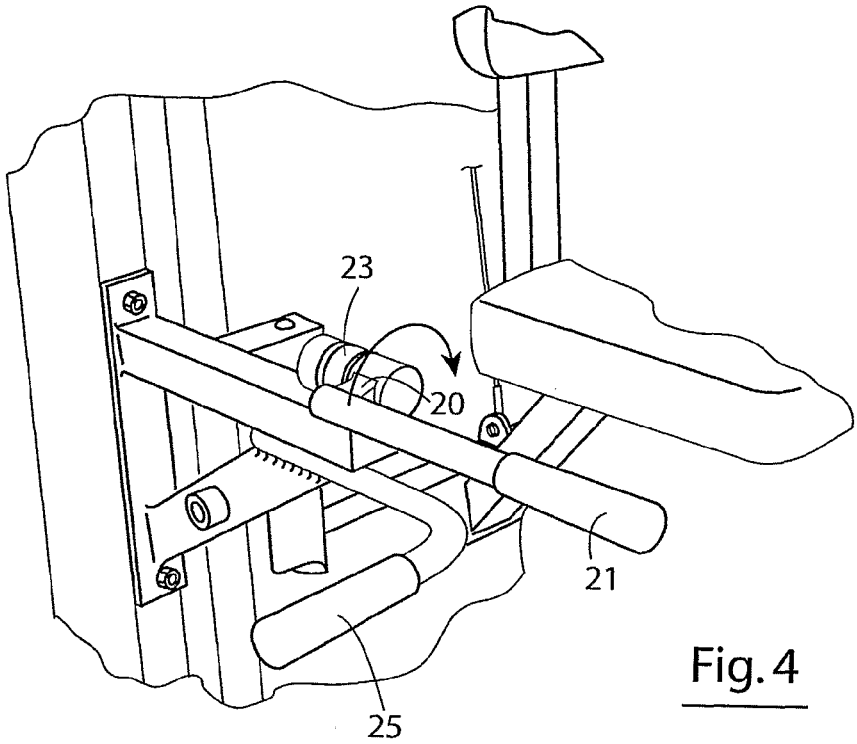
FIG. 4 is a perspective view of a detail of a pull-up and a parallel bar of the apparatus.
Figure 5A:
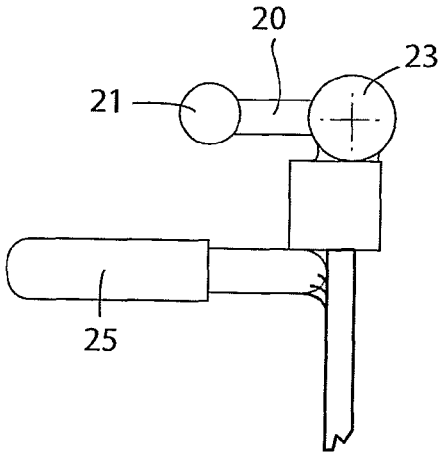
FIGS. 5*a* and 5*b* are perspective views of the bar of FIG. 4 in different positions of use.
Figure 5B:
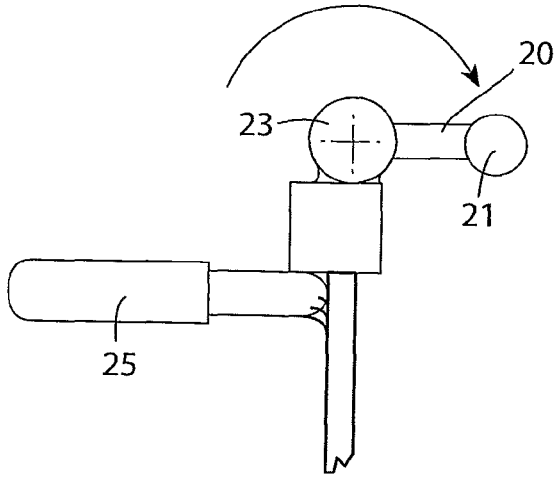
Figure 6:
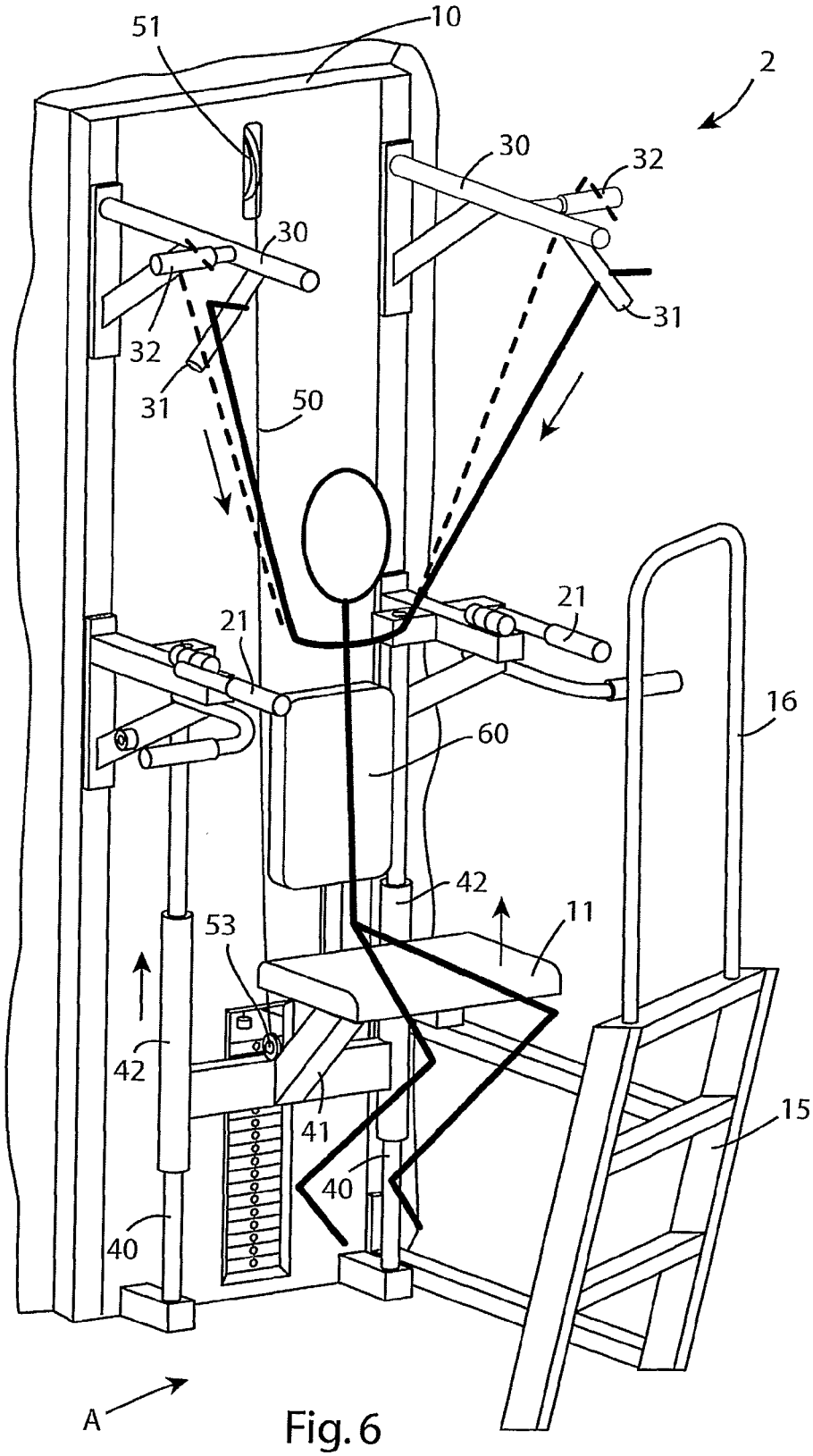
FIGS. 6 to 9 are perspective views of the apparatus of FIGS. 2 to 5 illustrating performance of various exercises.
Figure 7:
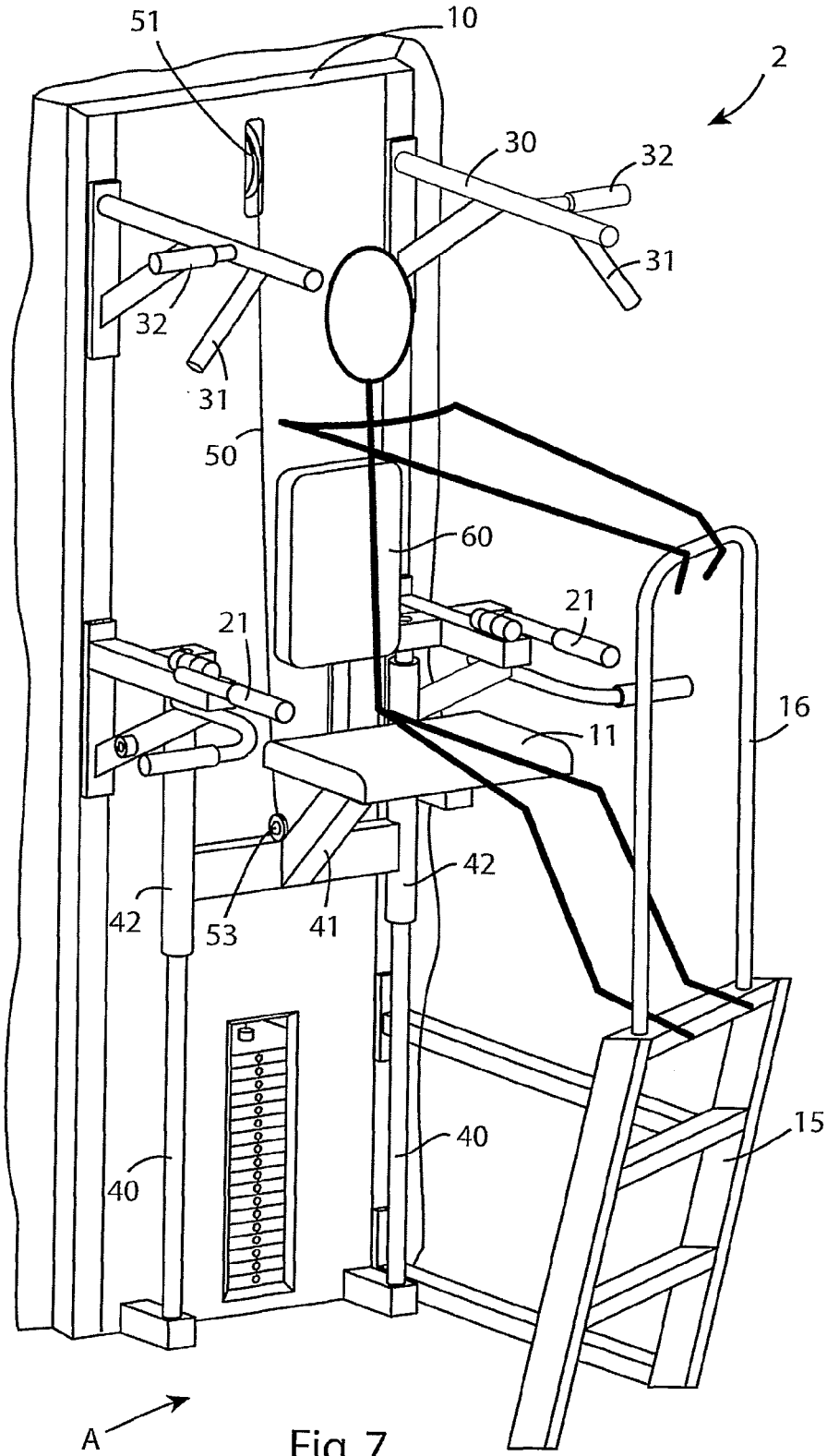
Figure 8:
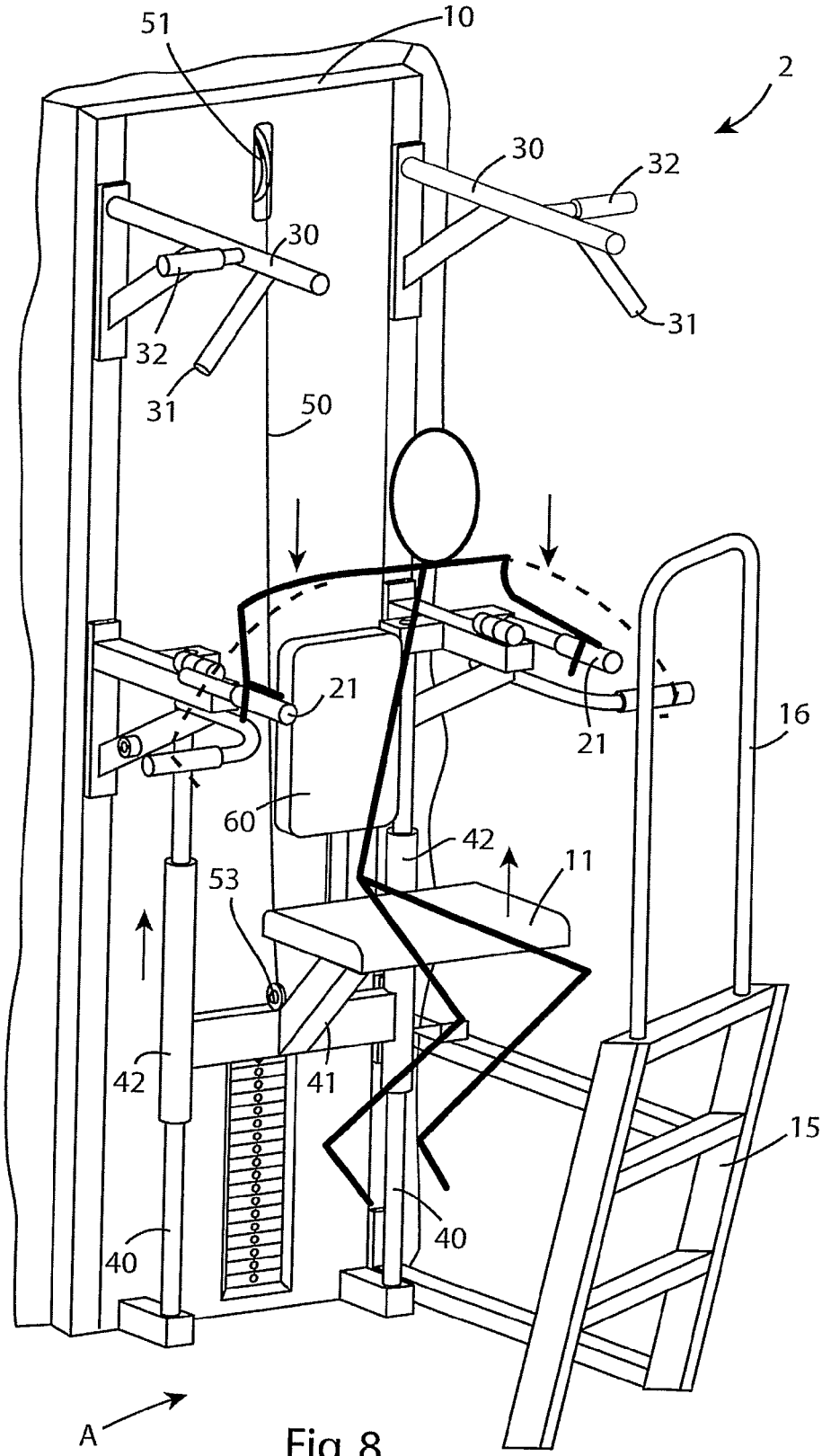

Referring to FIG. 1 there is illustrated a multi station exercise unit 1. In this case four stations are illustrated:

- a first exercise station 2 for the chest and back;
- a second exercise station 3 for exercising the lower abdominals;
- a third exercise station 4 for exercising the front and back of the legs; and
- a fourth exercise station 5 for exercising multiple body parts.

There may also be further stations (not illustrated) such as a weight stack with pulley and handle, and/or an exercise station for the arms. The exercise station 2 for the chest and back will be described in more detail with reference to FIGS. 2 to 9. The exercise station 3 for the lower abdominals will be described in more detail with reference to FIG. 10 and, the exercise station 4 for the legs will be described with reference to FIG. 11. The exercise station 5 for multiple body parts is described in more detail in our co-pending PCT application QUI001 of even date, the entire contents of which are herein incorporated by reference.

It will be appreciated that the various exercise stations may be in the form of separate stand-alone exercise units.

Referring to FIGS. 2 to 8 exercise apparatus 2 for exercising particularly the chest and back comprises a frame 10, bars for gripping by the user in performing various exercises, a seat 11 for supporting a user during exercise, and a resistance means, in this case in the form of a weight stack 12 for the seat 11. The seat 11 is vertically movable relative to the frame 10 as exercises are being performed. There is also a ladder 15 with a top grip rail 16 for safe and convenient access for a user in mounting and demounting from the seat 11.

In this case the bars comprise a pair of laterally spaced-apart parallel bars 21 attached to the frame 10. The parallel bars 21 extend anteriorly on either side of the seat 11 and are spaced-apart at a width that is appropriate for performing dip exercises by various users. The gap between the parallel bars 21 may be readily width adjustable by any suitable means. In this case, and referring especially to FIGS. 4, 5(*a*) and 5(*b*) each bar 21 has a crank 20 close to its attachment to the frame 10. A bushing 23 allows a 180 degree rotation from the position illustrated in FIG. 5(*a*) to the position illustrated in FIG. 5(*b*). There are also sidewardly extending hand grips 25 adjacent to the parallel bars 21. The band grips 25 may be used to perform exercises in where the angles of the arms are varied as illustrated particularly in FIG. 8.

It will be appreciated that the parallel bars 21 may be attached by means of a vertically or horizontally or angularly variable attachment to allow for the needs of larger or smaller individuals, or to allow for different variations on the exercises to be performed.

The bars also in this case comprise a pair of laterally spaced-apart overhead bars 30 which are provided at an appropriate height for performing pull-ups. The bars 30 may have a downward crank 31 (about 150 mm) at each end and anteriorly projecting parallel handles 32 fixed to the bar approximately at the point of the crank.

In an alternative embodiment, the overhead bar may be vertically variable in height to accommodate very tall persons, and in yet another alternative, the downward-cranked ends of the bar can be moved in towards one another for performing further variations on the basic exercises mentioned.

The several hand grips on the parallel and overhead bars 30, 21 facilitate multi-angular exercises with different angles of grip. This assists in muscle development.

The apparatus 2 which may be a stand-alone machine or part of a multi-station unit allows the user to perform pull-ups on an overhead bar and dips on parallel bars by providing a variably counterbalanced seat which moves vertically as the exercise is performed, together with a ladder apparatus for easily and safely accessing the seat.

The seat 11 is slidably mounted on two vertical guide bars 40 which are firmly fixed to the frame 10. The seat 11 comprises a metal box section frame 41 with two attached guide tubes 42 containing two linear bearings in each tube 42. The apparatus is assembled in such a way that the guide bars 40 run one in each guide tube 42 which allows the seat 11 to freely move up and down.

The seat 11 is attached to a system for providing variable levels of support or counterbalance (negative resistance). In the present embodiment, this consists of a cable 50 which is attached at 53 to the seat frame and which runs through a system of pulleys (in the preferred embodiment, a single pulley 51), which is attached to a resistance mechanism (in the preferred embodiment, a weight stack 52). In this embodiment the single pulley 51 is rotationally mounted at the top of the frame 10.

The weight stack 52 comprises a plurality of weights and a selector bar which extends through the stack. The weights each have holes 53 and the desired number of weights from the weight stack are attached to the selector bar by engaging a weight stack selector pin 54 into one of the weight stack holes 53. The selector bar is not mounted to the frame so that during exercises such as those illustrated in FIGS. 6 to 8 the number of weights attached to the selector rod move to provide negative resistance.

The seat also has a back support 60 which is fixed to the seat support frame 41. Thus, the seat elements 60, 11 ensure that a user's posture is correct and that the user is in a correct position for performing the exercises. Because the user position is fixed in this way exercise is optimised to concentrate on particular muscles and prevents a user swaying as might happen were he standing on supports, or kneeling.

The positioning and angle of the ladder 15 to the front and one side of the seat 11 is important in ensuring that a user is guided in the direction of the arrow A, to correctly mount to and demount from the seat. The rail 16 and its position and angle also help prevent a user from mounting the seat from the wrong side. The top of the rail 16 can also be used as a hand grip in performing some exercises.

Figure 9:
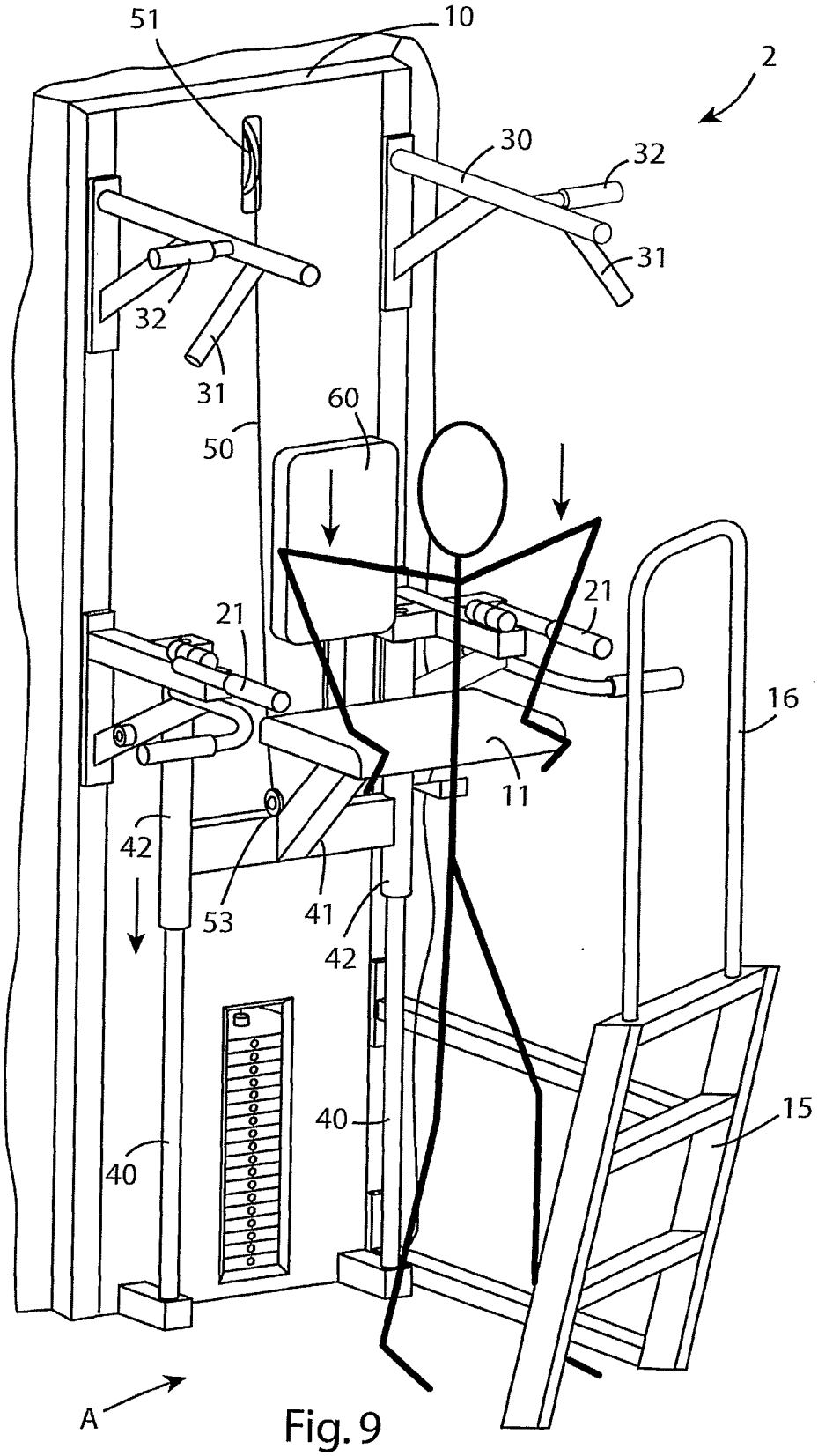

The range of motion of the seat 11 is designed to allow a wide range of users with different arm and body trunk lengths to effectively perform dips or overhead pull-ups. Some of the exercises that can be performed using the apparatus of the invention are illustrated in pages 6 to 9. Referring to FIG. 9 an exercise is illustrated which trains the Latissimus or triceps muscles depending on the angle at which the user maintains his or her body with respect to the seat. In this type of use the weight stack offers positive resistance to the extension of the arms from a flexed position behind the back. The seat is used as a lever to allow a pressing-down movement.

Figure 10:
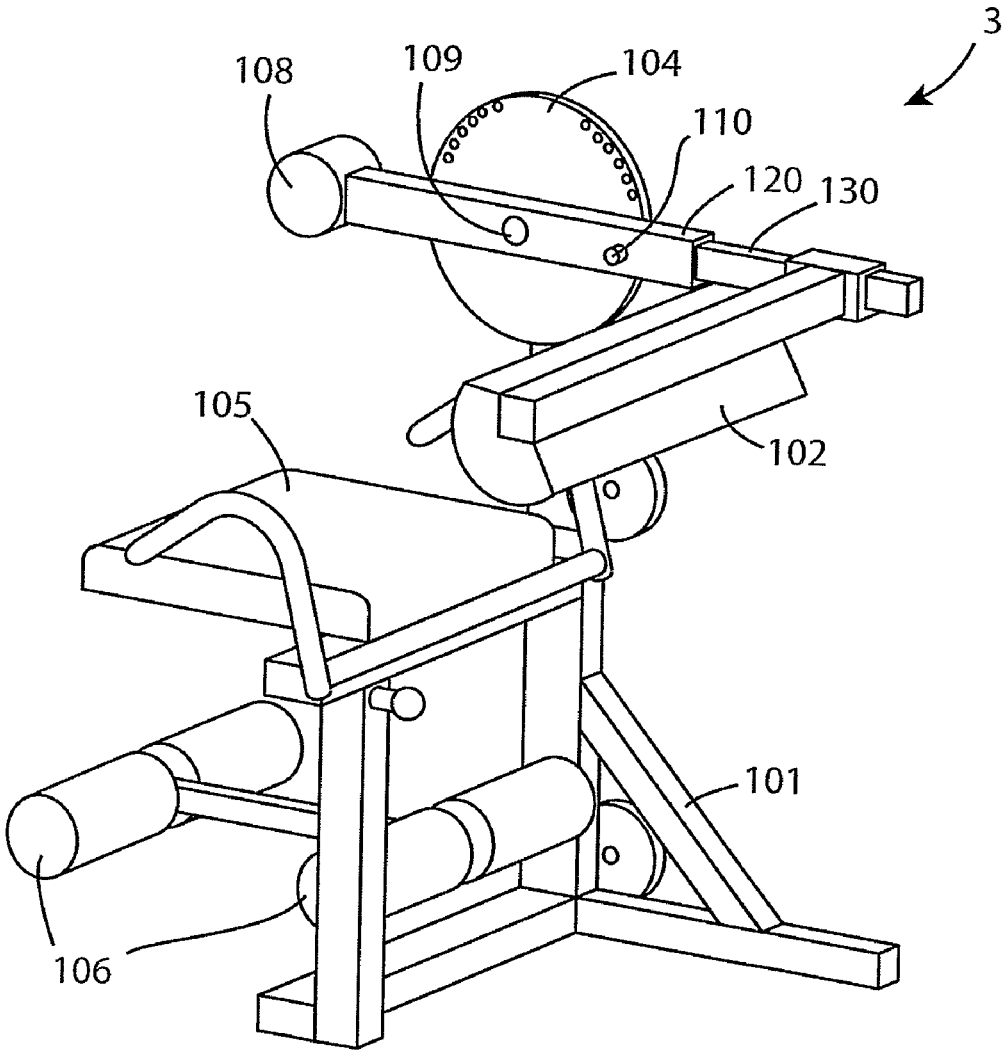
FIG. 10 is a perspective view of another exercising apparatus according to the invention for resistance training of abdominal muscles.

Referring now to FIG. 10 exercisers who wish to develop the abdominal muscles may find that while the lower abdominals are in principle easy to isolate in an exercise, it is particularly hard to successfully apply increased resistance in exercising this body part.

The present invention addresses this problem by providing such a system as an extension of a conventionally known system for upper abdominal exercise and low back hyperextensions.

Referring to FIG. 10 the exercise station 3 for exercising the lower abdominals is shown in more detail. The apparatus 3 may be a stand-alone machine or part of a multi-station unit. The apparatus 3 allows the user to perform lower abdominal resistance exercise and it may also be adapted to perform upper abdominal exercise and hyperextensions for the low back. The apparatus consists of a frame 101, a padded bar 102 attached to a lever 103 having a counterweight 108. The lever 103 can be longitudinally adjusted in a sleeve 120 which is in turn attached to a circular plate 104 in such a way that the angle of attachment is variable. The apparatus also comprises a seat 105, restraints 106 for the ankles, and a pair of hand bars 107. The circular plate 104 is attached to a cam and pulley which is attached to a resistance device such as a weight stack (not shown). The padded bar 102 may be placed in such a position that the user may put upward pressure on it with his knees while maintaining his upright sitting posture by holding the hand bars 107, thus exercising the lower abdominals.

The resistance unit consists of the padded bar 102 which is attached to the lever 103 which is in turn attached at right angles by means of a pivot to a shaft. The lever may extend backwards beyond the pivot point and carry the counterweight 108. Firmly attached to the shaft is the circular plate 104 with holes drilled about the edge, whereby a spring pin 110 on the lever 103 may engage the circular plate 104, to allow variation in the rotational angle of attachment. Attached to the other end of the shaft is a cam, in turn connected to a cable which activates a resistance device, in the preferred embodiment a weight stack. The facility of variation in the rotational angle of attachment is used in converting the unit from lower back to upper abdominal to lower abdominal use.

Figure 11:
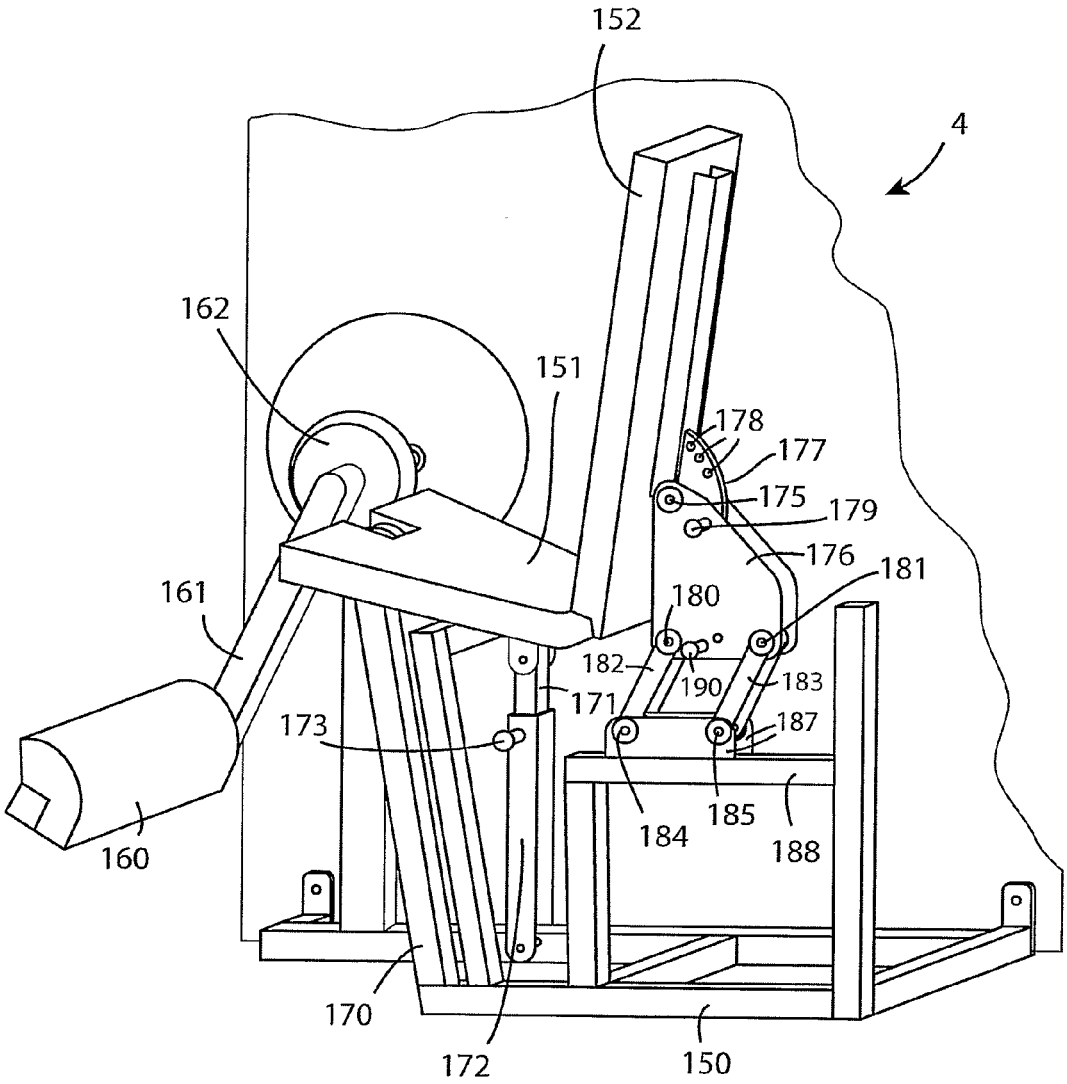
FIG. 11 is a perspective view of a further exercising apparatus according to the invention for exercising the front and backs of the legs in one unit.

Referring to FIG. 11 the exercise station 4 for exercising the front and back of the legs is illustrated in more detail. The apparatus 4 may be a stand-alone machine or part of a multi-station unit.

In FIG. 11 a weight training machine is illustrated which is compact and provides one station which can perform more than one function. This invention provides a system for a user to easily convert a machine from use for leg extensions to use for thigh curls.

In the case of the leg extension exercise, a particular problem arises, as when the centre of angular movement of the knee joint is not coincident with the centre of angular movement of the machine this may cause strain on the ligaments of the knee, as well as resulting in a suboptimal exercise. For this reason prior art has often provided a mechanism whereby the user may set the horizontal position of the seat according to his needs. Such mechanisms however require the user to dismount and select the seat position by trial and error. This problem is solved in the present invention by a mechanism which allows the user to adjust the anterior-posterior position of the seat back while remaining seated on the unit, so easily finding the optimal position. Furthermore by having the front edge of the seat in a fixed position as opposed to allowing the seat to be moved, the knee joint is in every case placed in exactly the correct position for the exercise, so allowing for more accurate performance of the leg extension exercise than prior art.

Thus, FIG. 11 illustrates an exercise machine 4 which may be stand-alone or part of a multi-station unit, adaptable for performing medium to heavy weight training for the quadriceps or the hamstrings, consisting of a frame 150, a seat 151 having a back 152 of which is variable as to position both in the anterior-posterior plane and angularly. The parts 151, 152 can be converted into a suitably shaped bench.

A padded bar 160 is attached to lever 161 which is in turn attached at right angles to a cam 162 by means of a device allowing variation of about 180 degrees in the rotational angle of attachment. The cam 162 is connected to a cable connected in turn to a resistance device, in the preferred embodiment a weight stack (not shown). The frame may be of steel tubing.

The seat 151 and the seat back 152 are separate. In the position for performing leg extensions, the seat is fixed at the front on a supporting post 170 so that the knee will coincide with the centre of angular movement of the padded bar 160 and the lever 161. It is susceptible of variation in its angle of slope through adjustment of a posterior supporting post 171, which consists of a square tube with several holes through it which can slide in a sleeve 172 attached to the frame 150, and can be fixed by means of spring-loaded pin 173 which is attached to and extends through the sleeve 172.

The seat back 152 is attached by a pivot 175 to the upper part of a box section support 176. The angle of the seat back 152 is set by a mechanism, in this embodiment a plate 177 in the form of an arc set at right angles to the seat back 152 which is drilled at its edge with holes 178 which engage a spring-loaded pin 179 which is attached to and through the box section support 176.

The box section support 176 is attached by pivots 180, 181 at its lower corners to two linking members 182, 183 which are in turn attached by pivots 184, 185 at their lower corners to two linking members 187 which are in turn attached onto a horizontal member 188 of the frame 150, thus forming a four point linkage. Another plate (not shown) in the form of an arc is attached to the lower part of the seat back 152 and is engaged by another spring-loaded pin 190 which is attached to and through the box section support 176 at a point between the points of attachment of the pivots 180, 181 of the two linking members 182, 183.

The pin 190 is conveniently accessible and easily reachable by a user who is sitting on the seat 151 so allowing the possibility of smoothly adjusting the seat back 152 and keeping the knees in the correct position. The accessible position and possibility of operation of the pin while seated and the true horizontal movement achieved by the use of the four point linkage are important features of the invention.

The resistance is transmitted to the user by means of a padded bar attached to lever which is in turn attached at right angles to a cam by means of a device allowing variation of about 180 degrees in the rotational angle of attachment, the cam in turn being connected to a cable connected in turn to a resistance device, in the preferred embodiment a weight stack. The facility of 180 degrees variation in the rotational angle of attachment is used in converting the unit from leg extension to thigh curl use.

The invention provides a simple means to convert the machine from leg extension to thigh curl use. The padded bar 160 is elevated through 180 degrees as described, the box section support 176 is lowered to meet the frame member 185, the rear pillar 171 of the seat 151 is extended upwards and the seat 151 now becomes a support for the thighs, while the seat back 152 is rotated to an angle greater than 90 degrees, forming a slightly downward-sloping bench to support the chest. This position is optimal for performing thigh curls.

The invention is not limited to the embodiments hereinbefore described which may be varied in detail.

The invention claimed is:

1. Apparatus for exercising muscles of the chest and back comprising:

a frame;

bars for gripping by a user in performing exercises;

a seat having a back support for supporting a user in a sitting position during exercise;

resistance means for the seat;

the seat being movable relative to the frame as exercises are being performed by user; and a ladder for mounting onto and demounting from the seat, the ladder being attached to the frame located forward of the seat and extending at an inclination extending away from the seat with a top of the ladder tilting away from the seat relative to a vertical plane wherein the vertical plane is passing through a bottom of the ladder, the ladder being accessible to an individual to climb for reaching the seat when the seat is elevated above the floor and the ladder is needed for the individual to mount and demount from the seat.

2. Apparatus as claimed in claim 1 comprising guide means for guiding movement of the seat.

3. Apparatus as claimed in claim 2 wherein the guide means comprises guide rods and guide tubes for the guide rods.

4. Apparatus as claimed in claim 3 comprising linear bearings between the guide rods and guide tubes.

5. Apparatus as claimed in claim 1 wherein the bars comprise a pair of overhead bars for gripping by a user in performing pull-up exercises.

6. Apparatus as claimed in claim 5 wherein the overhead bars are height adjustable.

7. Apparatus as claimed in claim 5 wherein the overhead bars are fixed to the frame.

8. Apparatus as claimed in claim 1 wherein the bars comprise parallel bars for gripping by a user in performing dip exercises.

9. Apparatus as claimed in claim 8 wherein a gap between the parallel bars is width adjustable.

10. Apparatus as claimed in claim 1 wherein the seat is connected to the resistance means by a connection means.

11. Apparatus as claimed in claim 10 wherein the connection means comprises a connector which is trained over a pulley means.

12. Apparatus as claimed in claim 1 wherein the parallel bars are fixed to the frame.

13. Apparatus as claimed in claim 1 wherein the resistance provided by the resistance means is adjustable.

14. Apparatus as claimed in claim 1 wherein the resistance means comprises a weight stack.

15. Apparatus as claimed in claim 1 which is a stand-alone exercise machine.

16. Apparatus as claimed in claim 1 which comprises one station of a multi-station exercise machine.

17. Apparatus as claimed in claim 1, further comprising a rail extending upwardly of the ladder.

* * * * *